United States Patent [19]

Sieben et al.

[11] Patent Number: 4,854,076

[45] Date of Patent: Aug. 8, 1989

[54] REMOTELY OPERATED HATCH COVERS FOR TANK TRUCKS AND THE LIKE

[76] Inventors: Murray K. Sieben, Box 9; Gordon L. Rohs, Box 122, both of Denzil, Saskatchewan, Canada, S0L 0S0

[21] Appl. No.: 219,450

[22] Filed: Jul. 15, 1988

[51] Int. Cl.[4] ..... E05F 15/00

[52] U.S. Cl. ..... 49/280; 49/302; 49/334; 49/340; 49/344

[58] Field of Search ..... 49/280, 279, 302, 334, 49/339, 340, 344, 357

[56] References Cited

U.S. PATENT DOCUMENTS

| | | | |
|---|---|---|---|
| 1,435,638 | 11/1922 | Granger | 49/339 |
| 2,586,465 | 2/1952 | Hitschmann | 292/259 |
| 3,014,746 | 12/1961 | Hiby | 292/259 |
| 3,324,817 | 6/1967 | Olsson | 114/202 |
| 3,722,936 | 3/1973 | Stubert | 292/64 |
| 3,888,528 | 6/1975 | Jericijo | 292/256.5 |
| 4,024,983 | 5/1977 | Muehl | 292/259 X |
| 4,179,999 | 12/1979 | Cotten | 105/377 |
| 4,208,839 | 6/1980 | Candy, Sr. | 49/344 |
| 4,327,522 | 5/1982 | Meadows | 49/279 |
| 4,655,004 | 4/1987 | Caillet | 49/280 |
| 4,665,649 | 5/1987 | Hond, Jr. | 49/280 |

*Primary Examiner*—Philip C. Kannan
*Attorney, Agent, or Firm*—Irell & Manella

[57] ABSTRACT

An air cylinder operates a loose link cam fixed to a rod which pivots the hatch cover which is normally latched closed. As the cylinder is operated, the first portion of the movement unlatches the cover and the remainder of the movement swings the cover up to an over centre position whereupon it falls by gravity to the fully opened position without any further movement of the cylinder. The loose link cam permits the cover to move through approximately 180° during the opening motion. when closing the cover, the same action takes place with the latch moving to the closed position by means of a spring and being displaced by the cover falling to the closed position by gravity once it has been moved by the loose link cam to the over centre position. The upper surface of the latch hook is curved so that the edge of the cover cross bar strikes the latch and displaces same as the cover closes and which is then returned to the latching position by the spring.

20 Claims, 3 Drawing Sheets

REMOTELY OPERATED HATCH COVERS FOR TANK TRUCKS AND THE LIKE

BACKGROUND OF THE INVENTION

This invention relates to new and useful improvements in means for operating remotely, hatch covers for tank trucks and the like and although the specification and drawings relate to tank truck covers specifically, nevertheless it will be appreciated that the invention is equally applicable to the opening and closing remotely of any cover and including but not being limited by cargo hatches or railroad tank cars and the like.

Conventionally, such covers for hatches are opened manually which often means that the operator must climb to the top of the tank truck or railroad car and then unlatch the relatively heavy hatch cover and swing same from the closed to the open position and vice versa. Not only is this hazardous but also the contents of many such tank cars and the like often include vapors or gases which are toxic or unpleasant.

Prior art known to the applicant includes the following U.S. Patents:

U.S. Pat. No. 3,014,746, Dec. 26, 1961, F. K. Hiby. This Patent discloses door removal means for coke ovens and includes automatic locking arrangements which may be applied to existing coke oven doors with the minimum change to existing structure.

U.S. Pat. No. 2,586,465, Feb. 19, 1952, R. Hitschmann. This Patent relates to a manhole cover securing means which includes one or more round bars traversing the openings in the wall of the vessel and being freely supported in bearings secured to the wall at opposite ends of the opening.

U.S. Pat. No. 3,324,817, June 13, 1967, J. B. Olsson. This patent covers means for closing of large openings including a plurality of locking members which are designed to be operated simultaneously by means of a common maneuvering body.

U.S. Pat. No. 3,722,936, Mar. 27, 1973, J. W. Stubert. This teaches a latching mechanism for access doors having a locking bolt pivotally mounted to a supporting bracket on the structure which may be swung into and out of engagement with a pair of mating troughs at the edge of the door and the opening.

U.S. Pat. No. 3,888,528, June 10, 1975, B. Jericijo. This Patent discloses a battening device for cargo hatches including a hydraulically operated hook member engaging with a pin on the hatch together with link arms and vertical guide members to ensure tight engagement between the hook member and the pin.

U.S. Pat. No. 4,024,983, May 24, 1977, H. D. Muehl. This Patent teaches a safety locking cover assembly for the dome of a tank truck and is operated by the pivotal movement of a semi-circular handle which pivots upon a locking bar extending beneath the cover top.

U.S. Pat. No. 4,179,999, Dec. 25, 1979, S. E. Cotten. This shows a hatch cover closure system for use on hopper cars and includes a resilient flexible strap to secure the cover being coupled together by a floating link and raised and lowered as a unit about a hatch cover hinge.

The present invention overcomes difficulties inherent with conventional hatch or hopper car covers by providing a piston and cylinder assembly for opening and closing the hatch which may be operated remotely such as in the cab of a truck thus removing the operator completely from any physical engagement with the process of opening or closing the hatch with the exception of operating the fluid supply to the piston and cylinder assembly.

In accordance with the invention there is provided an opening and closing assembly for hatches etc. as per claim 1 (Extend).

Another advantage of the invention is that it is easily incorporated for use with existing hatch covers and may be supplied as a kit or may be incorporated during manufacture.

The device is adapted to be operated by hydraulic or compressed air depending upon the source of supply which may be available. In most tank trucks used on highways, a source of compressed air is normally available and is perhaps the most convenient method of operating the system.

Still another advantage of the invention is to provide a device of the character herewithin described which is simple in construction, economical in manufacture and otherwise well suited to the purpose in which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
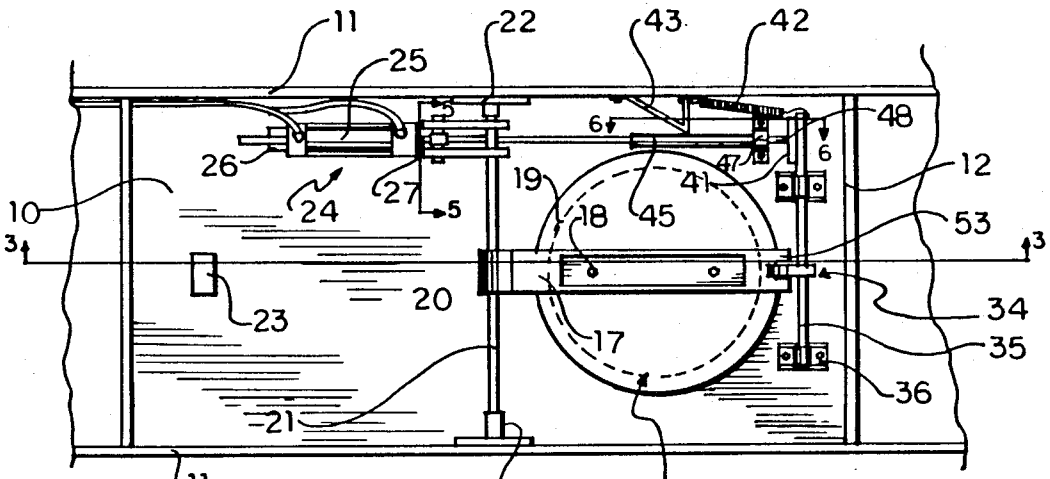
FIG. 1 is a fragmentary top plan view showing the invention installed in conjunction with a tank car hatch assembly in the closed position.
Figure 2:
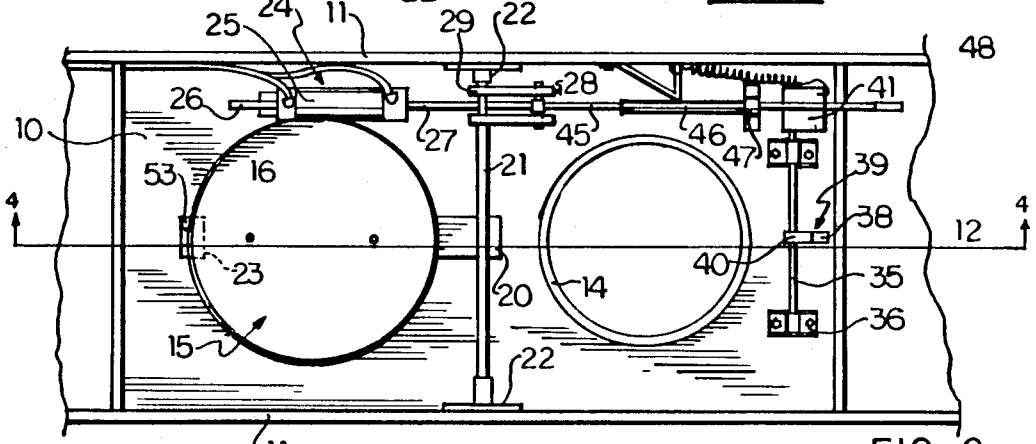
FIG. 2 is a view similar to FIG. 1 but showing the hatch cover in the open position.

Proceeding therefore to described the invention in detail, reference should first be made to FIGS. 1 and 2 in which 10 illustrates the upper side of a tank car or the like having vertical side plates or member 11 and a cross plate or member 12 referred to as supporting structure in one or more of the claims.

A hatch opening 13 is formed through the upper surface 10 and this opening is surrounded and defined by an annular collar 14 and although this is shown to be circular, nevertheless it will be appreciated that it can be rectangular or any other configuration desired. However, conventionally, such hatches are circular as illustrated.

A hatch cover collectively designated 15 consists of a substantially planar plate having an overall configuration to match the collar 14 and having a depending annular collar 16 adapted to engage over the collar 14 of the opening when the cover is in the closed position.

Means are provided to hingedly support the cover upon the supporting surface and in this embodiment includes a transverse strap 17 secured to the upper surface of the cover 15 and extending diametrically fore and aft with respect to the drawings. It may be bolted to the cover or otherwise secured, bolts being indicated by reference character 18.

The ends of this strap extend beyond the periphery 19 of the cover and one end 20 is curved over and secured as by welding to a cross shaft 21 journalled between bearings 22 secured to the vertical sides 11 of the upper side of the tank car.

Figure 3:
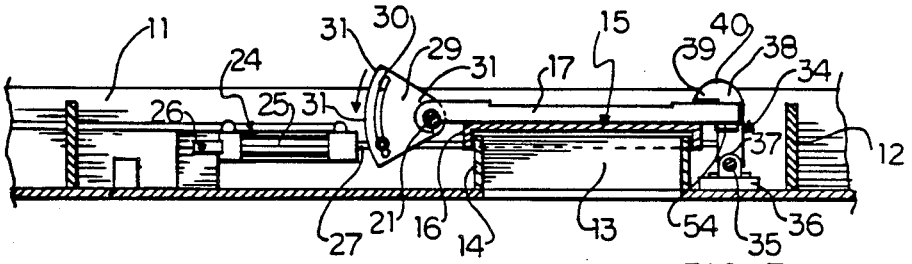
FIG. 3 is a fragmentary partially crosssectional view of FIG. 1 substantially along the line 3—3 of FIG. 1.
Figure 4:
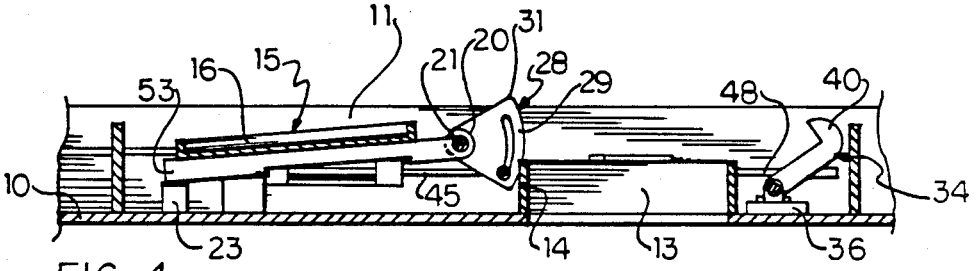
FIG. 4 is a view similar to FIG. 3 but taken along the line 4—4 of FIG. 2.
Figure 5:
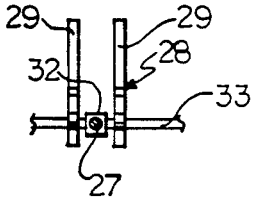
FIG. 5 is a fragmentary partially crosssectional view along the line 5—5 of FIG. 1.

The bearings 22 and cross shaft 21 are positioned so that the cover 15 will move through approximately 180° between the closed position shown in FIGS. 1 and 3 and the open position shown in FIGS. 2 and 4. In this connection, a bumper block 23 is provided upon the upper panel 10 of the tank truck to receive the upper side of the transverse strap 17 when the cover is in the fully open position shown in FIG. 4.

Under normal circumstances it is desirable to have the cover assembly 15 move to the fully opened position where it may lie substantially planar rather than endeavoring to support it in the partially open position due among other things, to the weight of the cover and also in order to provide complete access to the opening 13 for the loading and/or discharge of the contents of the tank car or the like.

It is therefore somewhat difficult and requires considerable mechanism to provide remotely controlled automatic opening and closing mechanism which will move the cover through approximately 180°. The present invention solves this problem by initiating movement in either direction to an over centre position and then provides loose linkage which enables the cover to fall the remaining distance by gravity both in the opening and closing positions.

In this connection, the actuator consists of a piston and cylinder assembly collectively designated 24 which is preferably air operated from a source of compressed air (not illustrated) and controlled remotely, preferably from within the cab of the vehicle. However other remote locations may of course be provided depending upon design parameters.

The cylinder 25 is pivotally mounted upon a pivot pin 26 and supported from the upper panel 10 of the supporting structure with the piston rod 27 extending towards the cross shaft 21.

An operating cam assembly collectively designated 28 is secured to the cross shaft 21 and consists of a pair of substantially triangular plates 29 secured adjacent the apex of the plate 31 thereof to the cross shaft 21 as by welding or the like. These plates extend spaced and parallel from one another and perpendicular to the axis of rotation of the shaft and rotate therewith as does the cover assembly 15.

Arcuately curved slots 30 are formed in each plate adjacent the edge 31 remote from the connection to shaft 21 and the centre of curvature of these closed ended slots is substantially along the axis of rotation of shaft 21.

A clevis 32 is secured to the distal end of the piston rod 27 and includes a cross pin 33 engaging the slots of the two cam plates 29, it being understood that this cross pin 33 may run freely within the arcuate slots pivoting around the axis of rotation of shaft 21 as the cams plates are rotated therewith.

A latch member collectively designated 34 is provided for the cover in order to maintain the cover in the fully closed position shown in FIGS. 1 and 3. This latch member includes a latch shaft 35 supported in bearings such as pillow blocks 36 secured to the upper panel 10 and transversely of this panel, on the opposite side of the opening 13 to that of the cross shaft 21. One end 37 of the latch lever 34 is secured to this shaft 35 and rotates therewith.

Figure 6:
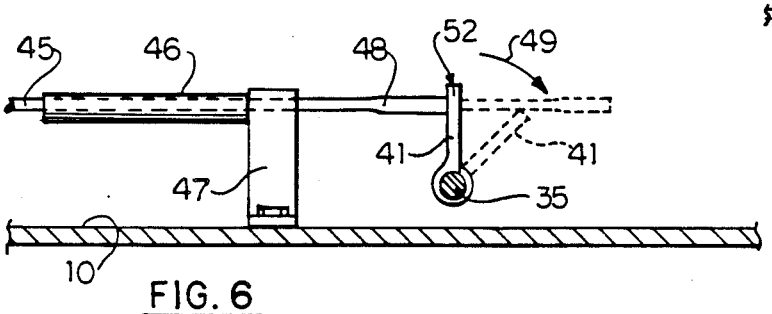
FIG. 6 is a fragmentary partially crosssectional view along the line 6—6 of FIG. 1.

The other end 38 is in the form of a detent or hook 39 having a curved upper surface 40, the purpose of which will hereinafter become apparent. A striker plate 41 is also secured to the latch shaft 35 towards one end thereof and normally extends upwardly therefrom as shown in FIG. 6 and a tension spring 42 operatively extends between this striker plate 41 and a support 43 extending from one side plate 11 of the supporting structure and normally maintains the latch member 34 in the substantially vertical or latching position shown in FIG. 3 of the drawings.

Figure 7:
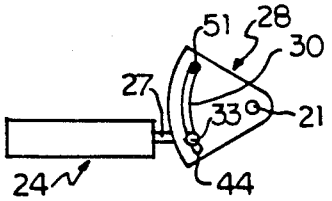
FIG. 7 shows a schematic view of the piston and cylinder and cam plates in the hatch closed position.
Figure 8:
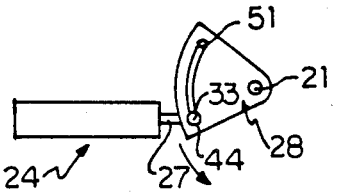
FIG. 8 shows a schematic view of the piston and cylinder and cam plate at the initiation of the opening of the hatch.

It will therefore be appreciated that it is necessary to disengage this latch from the cross member 17 prior to initiation of movement of the cover 15 towards the open position and reference should be made to FIGS. 3, 7 and 8.

When the cover is in the fully closed position shown in FIG. 3, the clevis cross pin 33 is spaced upwardly from the lower closed end 44 of the arcuate slots 30 of the cam plates and it will also be noted that the piston and cylinder assembly 24 is in the fully retracted position.

Initiation of the operation of the piston and cylinder assembly will extend the piston rod 27 for the first portion of the movement which will thus move the cross pin downwardly to the lower closed ends 44 of the plates to a position shown in FIG. 8.

This initial movement is used to unlatch the cover prior to initiation of the opening movement thereof and in this connection it will be seen that an operating rod 45 extends from the clevis 32 alongside the hatch and towards the latch shaft 35. It is supported for lengthwise movement within a tubular guide 46 supported upon a bracket 47 extending upwardly from panel 10 and shown in detail in FIG. 6. The distal end 47 of this rod 45 normally engages the striker plate 41 adjacent the upper side thereof when the hatch is in the closed position.

Figure 8A:
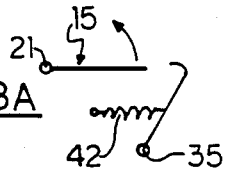
FIG. 8A is a schematic view showing the position of the hatch and latch mechanism corresponding to the cam position of FIG. 8.

However, the initial movement of the cross pin 33 from the position shown in FIG. 7 to the position shown in FIG. 8 initiates rotation of the striker plate 41 in the direction of arrow 49 which rotates latch shaft 35 and latch 34 to the position shown schematically in FIG. 8A in which the detent 39 is just clear of the cross strap 17 thus releasing the cover.

Figure 9:
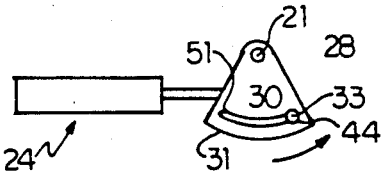
FIG. 9 is a schematic view of the piston and cylinder and the cam plate assembly with the hatch at the over centre position during the opening action.
Figure 9A:
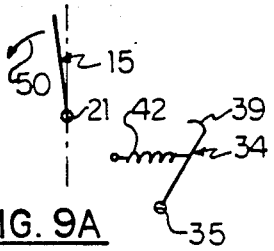
FIG. 9A is a schematic view of the hatch and latch assembly corresponding to the cam position of the FIG. 9.

Further extension of the piston and cylinder assembly rotates the cam plates to the position shown schematically in FIG. 9 an also of course rotates the cross shaft 21 and the cover 15 to a position just over centre and shown schematically in FIG. 9A.

Being over centre, the weight of the cover causes the cover to continue in the direction of arrow 50 (FIG. 9A) which then falls by gravity until it strikes the bumper 23.

Figure 10:
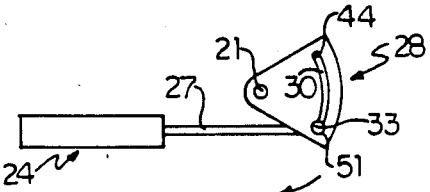
FIG. 10 shows the piston and cylinder assembly and the cam assembly when the hatch is in the fully opened position.
Figure 10A:
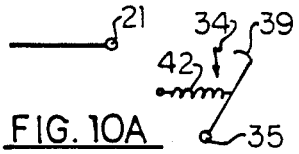
FIG. 10A is a schematic view of the hatch and latch assembly in the fully open position.

This rotates the cam plates to the position shown schematically in FIG. 10 and also shown in FIG. 4 without further extension of the piston and cylinder assembly 24 due to the cross pin 33 moving along the arcuate slots 30 the opposite closed end thereof 51 shown in FIG. 10 with the cover being shown schematically in the fully open position in FIG. 10A.

It will be observed that the cam plates have moved from the left hand side of the cross shaft 21 with reference to FIG. 1 to the right hand side thereof as shown in FIG. 2, the cam plates passing under the cross shaft 21.

When the piston and cylinder assembly are in the fully extended position it should be observed that the rod 45 has moved further away from the piston and cylinder assembly 24 due to the movement of the cross or clevis pin 33 thus overriding the top side or upper edge 52 of the striker plate 41 as shown in phantom in FIG. 6 thus holding the latch lever in the fully open position and completely clear of the open hatch 13.

Figure 11:
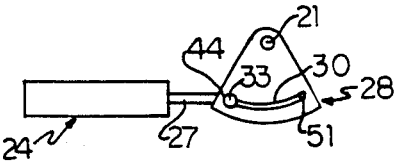
FIG. 11 is a schematic view of the piston and cylinder and latch plate assembly when the hatch is in the over centre position during the closing sequence.
Figure 11A:
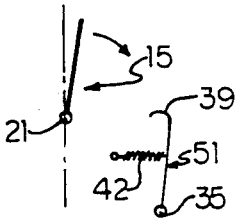
FIG. 11A is a schematic view of the hatch and latch assembly corresponding to the cam plate assembly of FIG. 11.

When it is desired to close the hatch cover, the piston and cylinder assembly 24 is retracted moving the cam plates to the position substantially as shown in FIG. 11 with the hatch in the opposite over centre position shown schematically in FIG. 11A. This initial movement of retraction of the piston and cylinder assembly fully retracts the rod 45 thus allowing spring 42 to return the striker plate 41 to vertical position shown in FIG. 6 with the detent lever 34 in the vertical or fully closed position shown in FIG. 3.

As the hatch cover passes over centre, it then falls freely by gravity towards the closed position with the cam plates 29 moving from the position shown in FIG. 11 to the position shown in FIG. 7.

Figure 7A:
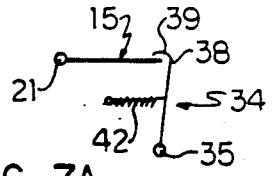
FIG. 7A shows a schematic view of the hatch in the closed position corresponding to the cam position of FIG. 7.

As the hatch cover closes by gravity from the over centre position of FIG. 11A towards the closed position shown in FIG. 7A, the other end 53 of the cross strap 17 strikes the upper curved surface 40 of the detent which acts as a cam and is forced outwardly away from the end 53 of the strap against pressure of spring 42 thus allowing the cover to close completely whereupon the spring 42 returns the latch lever 34 to the latched position shown in FIG. 3 and FIG. 7A.

In order to prevent any spark occurring as the cover closes and strikes the curved surface 40 of the detent, it is preferable that a non-ferrous pad 54 be secured to the underside of the other end 53 of the cross strap as by welding or the like.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. An opening and closing assembly for hatch covers and the like comprising in combination a hatch cover, supporting structure and means to hinge said cover adjacent one edge thereof, to said supporting structure for movement between a closed position covering an opening and an open position uncovering the opening and vice versa, means for moving said hatch cover from the closed and open positions to an over centre position whereby said cover then moves by gravity from said over centre position to the open and closed positions respectively, piston and cylinder means including a piston rod for operating said last mentioned means, latch means for detachably securing said hatch cover in the closed position, further means for disengaging said latch means from said cover prior to opening said cover and means to engage said latch means with said cover when said cover moves to the closed position.

2. The assembly according to claim 1 in which said piston and cylinder assembly is air operated.

3. The assembly according to claim 1 in which said means to hinge said cover includes a transverse strap spanning said cover and extending upon the opposite edges thereof, a cross shaft journalled for rotation upon said supporting structure adjacent one of said opposite edges of said cover, one end of said transverse strap being secured to said cross shaft and rotatable therewith, said means for moving said hatch cover from the closed and open positions includes an operating cam assembly also secured for rotation to said cross shaft and loose linkage connection means extending between said cam assembly and said piston and cylinder assembly, operation of said piston and cylinder assembly moving said cam assembly and hence said cross shaft and cover attached thereto, to a position whereby said cover is over centre and then falls by gravity to the fully open or closed positions selectively, said loose linkage cam assembly freeing said cover and said cross shaft for said falling by gravity of said cover.

4. The assembly according to claim 3 in which said latch means includes a lever, lever shaft means journalled for rotation upon said supporting structure, said lever being secured by one end thereof to said lever shaft, and transverse strap engaging detent means on the other end of said lever.

5. The assembly according to claim 4 in which said means for disengaging said latch means from said cover prior to opening said cover includes a striker plate secured to and extending upwardly from said lever shaft and means operatively extending from said piston rod to said striker plate and adapted to engage said striker plate and rotate said lever shaft thereby disengaging said detent means from said cover edge prior to the commencement of opening of said cover.

6. The assembly according to claim 3 in which said loose linkage cam assembly includes at least one cam plate secured to said cross shaft and extending perpendicularly therefrom, a closed arcuately curved slot formed through said plate at a position spaced from the securement of said plate to said cross shaft, means operatively connecting the piston rod of said piston and cylinder assembly within said slot for free movement therewithin from one end to the other.

7. The assembly according to claim 6 in which said latch means includes a lever, lever shaft means journalled for rotation upon said supporting structure, said level being secured by one end thereof to said lever shaft, and transverse strap engaging detent means on the other end of said lever.

8. The assembly according to claim 6 which includes a pair of spaced and parallel cam plates extending from said cross shaft, a closed arcuately curved slot in each plate, the centre of curvature of said slots being substantially on the axis of rotation of said cross shaft and clevis means operatively connecting said piston rod to said slots in said plates and being located between said plates.

9. The assembly according to claim 8 in which said latch means includes a lever, lever shaft means journalled for rotation upon said supporting structure, said lever being secured by one end thereof to said lever shaft, and transverse strap engaging detent means on the other end of said lever.

10. The assembly according to claim 9 in which said means for disengaging said latch means from said cover prior to opening said cover includes a striker plate secured to and extending upwardly from said lever shaft and means operatively extending from said piston rod to said striker plate and adapted to engage said striker plate and rotate said lever shaft thereby disengaging said detent means from said cover edge prior to the commencement of opening of said cover, said means operatively extending from said piston rod including a rod operatively connected to said clevis means by one end thereof, means to support said rod for lengthwise movement as said cam plate rotates, the other end of said rod engaging said plate and partially rotating said, the initial movement of said clevis means moving freely within said slots, rotating said latch shaft thereby disengaging said detent means from said cover prior to the initiation of rotation of said cross shaft.

11. The assembly according to claim 10 in which said clevis means is situated spaced from one end of said arcuate slots when said cover is in the fully closed position whereby initial operating of said piston and cylinder assembly moves said clevis to said one end of said slots and then commences movement of said cam plates, said clevis means being situated at the other end of said slots when said cover is in the fully opened position.

12. The assembly according to claim 11 in which said piston and cylinder assembly is air operated.

13. The assembly according to claim 8 in which said clevis means is situated spaced from one end of said arcuate slots when said cover is in the fully closed position whereby initial operating of said piston and cylinder assembly moves said clevis to said one end of said slots and then commences movement of said cam plates, said clevis means being situated at the other end of said slots when said cover is in the fully opened position.

14. The assembly according to claim 13 in which said piston and cylinder assembly is air operated.

15. The assembly according to claim 1 in which said latch means includes a lever, lever shaft means journalled for rotation upon said supporting structure, said lever being secured by one end thereof to said lever shaft, and cover engaging detent means on the other end of said lever.

16. The assembly according to claim 15 in which said means for disengaging said latch means from said cover prior to opening said cover includes a striker plate secured to and extending upwardly from said lever shaft and means operatively extending from said piston rod to said striker plate and adapted to engage said striker plate and rotate said lever shaft thereby disengaging said detent means from said cover edge prior to the commencement of opening of said cover.

17. The assembly according to claim 1 in which said latch means includes a lever, lever shaft means journalled for rotation upon said supporting structure, said lever being secured by one end thereof to said lever shaft, and cover engaging detent means on the other end of said lever, said means to engage said latch means with said cover including a curved camming surface formed on the upper side of said detent means engagable by said cover as it falls by gravity towards the closed position, the engagement of said cover with said curved surface urging said latch means away from said cover as same closes and spring means reacting between said latch means and said supporting structure normally urging said latch means towards the closed position.

18. The assembly according to claim 17 in which said means to engage said latch means with the other end of said transverse strap means includes a curved camming surface formed on the upper side of said detent means engageable by said other end of said transverse strap means as said cover falls by gravity towards the closed position, the engagement of said other end of said transverse strap means with said curved surface urging said latch means away from said cover assembly as same closes, and spring means reacting between said latch means and said supporting structure normally urging said latch means towards the closed position.

19. The assembly according to claim 18 which includes a non-ferrous plate on the under side of said other end of said transverse strap means to eliminate the possibility of spark occurring as said other end of said strap strikes said upper curved camming surface.

20. The assembly according to claim 18 in which said piston and cylinder assembly is air operated.

* * * * *